US011390501B2

(12) United States Patent
Bonnet

(10) Patent No.: US 11,390,501 B2
(45) Date of Patent: Jul. 19, 2022

(54) PULLEY WITH SECURE OPENING

(71) Applicant: ZEDEL, Crolles (FR)

(72) Inventor: Guillaume Bonnet, Montbonnot Saint Martin (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 17/032,640

(22) Filed: Sep. 25, 2020

(65) Prior Publication Data

US 2021/0087028 A1 Mar. 25, 2021

(30) Foreign Application Priority Data

Sep. 25, 2019 (FR) ..... 1910560

(51) Int. Cl.
*B66D 3/04* (2006.01)

(52) U.S. Cl.
CPC ..... *B66D 3/046* (2013.01); *B66D 2700/026* (2013.01)

(58) Field of Classification Search
CPC ..... B66D 3/04; B66D 3/046; B66D 2700/026
See application file for complete search history.

(56) References Cited

U.S. PATENT DOCUMENTS

| | | | | |
|---|---|---|---|---|
| 798,652 | A * | 9/1905 | Boughman | B66D 3/046 254/405 |
| 2,374,118 | A * | 4/1945 | Moore, Jr. | B66D 3/046 254/406 |
| 7,168,687 | B2 | 1/2007 | Thompson | |
| 9,120,654 | B2 | 9/2015 | Chaumontet | |
| 2012/0012800 | A1 | 1/2012 | Chaumontet | |
| 2013/0022439 | A1 | 1/2013 | Groves | |

FOREIGN PATENT DOCUMENTS

| | | |
|---|---|---|
| CN | 106185676 A | 12/2016 |
| EP | 2 407 413 A1 | 1/2012 |

* cited by examiner

*Primary Examiner* — Sang K Kim
*Assistant Examiner* — Nathaniel L Adams
(74) *Attorney, Agent, or Firm* — Oliff PLC

(57) ABSTRACT

The pulley comprises a securing head and a first flange. A first shaft extends from the first flange. A second flange and a sheave are mounted rotatable around the first shaft with respect to the first flange. A rod is fixed to the first flange and mounted movable between a first position and a second position with a first movement. In the first position, the rod engages with the second flange to keep the second flange in the first position. In the second position, the rod allows rotation of the second flange. A blanking plate is fixed on the second flange and mounted movable between a first position and a second position with a second movement different from the first movement. The blanking plate partially covers the rod to prevent movement of the rod from the first position to the second position.

13 Claims, 3 Drawing Sheets

FIG 5
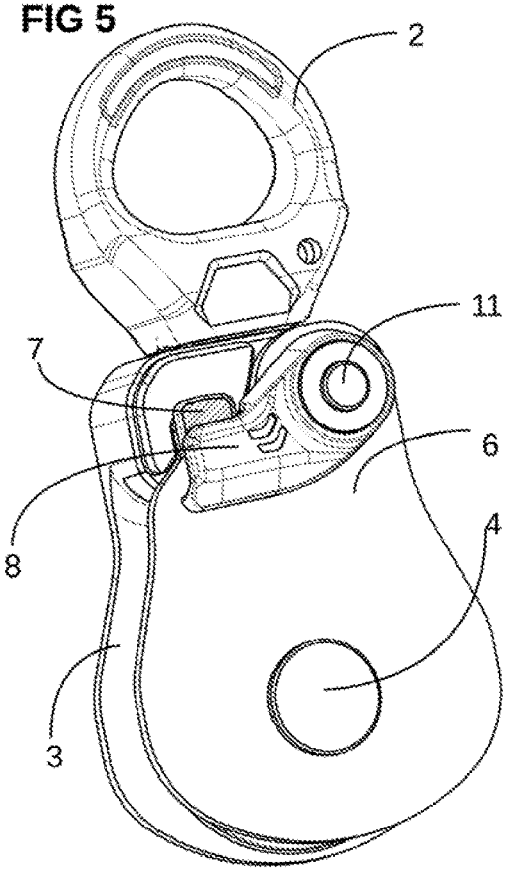
FIG 8
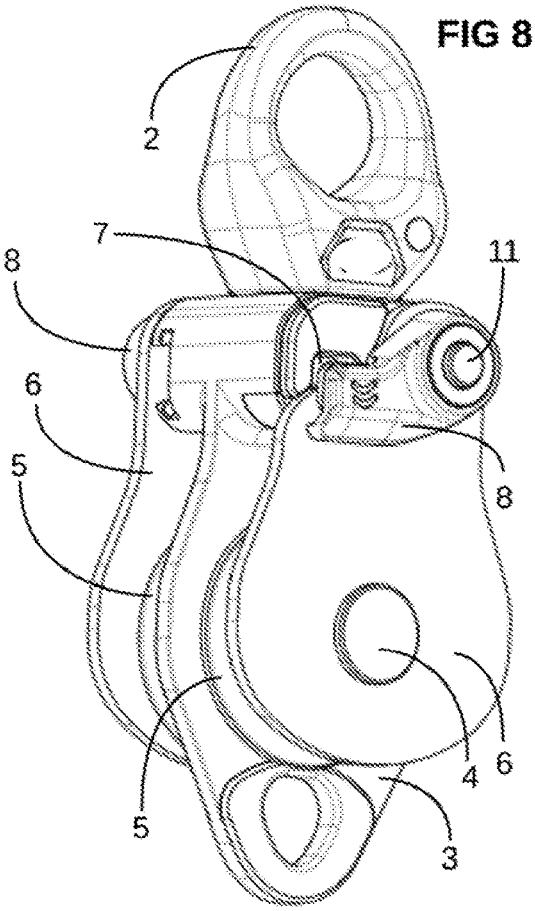
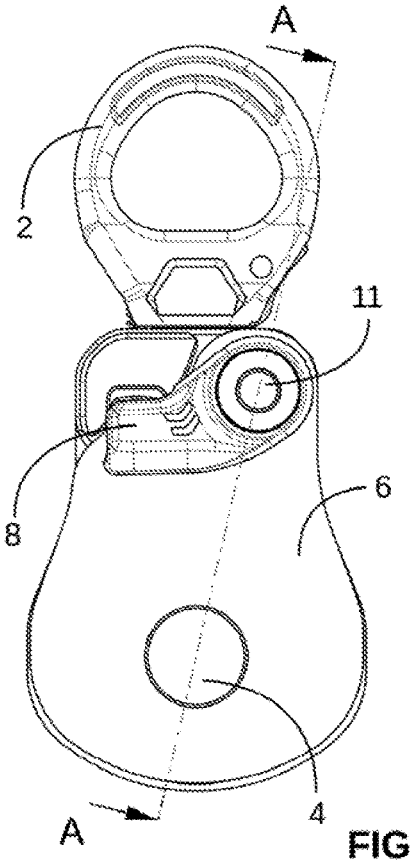
FIG 6A
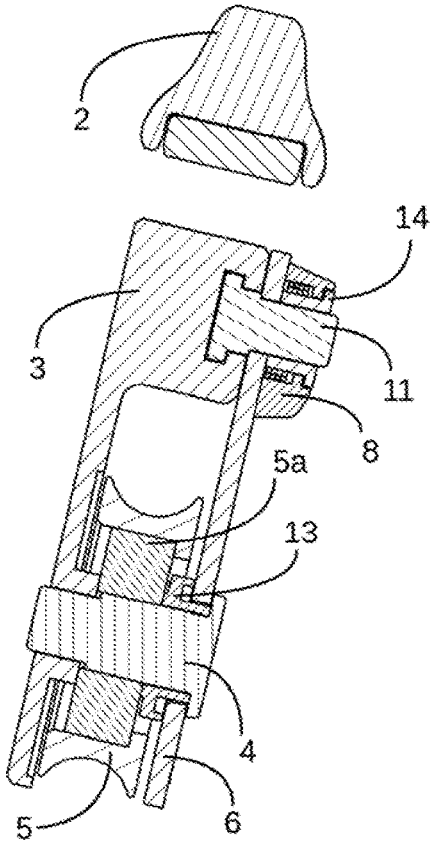
FIG 6B

PULLEY WITH SECURE OPENING

BACKGROUND

The invention relates to a pulley.

PRIOR ART

In a large number of fields, it is known to use a pulley composed of a securing head associated with a rotatable sheave. The pulley is attached to an anchor point by means of the securing head. The sheave enables the return force between a load to be hoisted and the force applied by the user to be modified. A rope connects the load to the user and the rope presses on the support formed by the sheave.

Pulleys are known comprising two flanges one of which is movable with respect to the other. The sheave is arranged between the flanges. In a particular configuration, the two flanges each define an opening. The two ends of the flanges form the securing head. The two openings are held together by a carabiner that performs attachment to the anchor point.

The document U.S. Pat. No. 7,168,687 describes another configuration in which the sheave is fitted between two flanges. One of the flanges is fixed to the securing head whereas the other flange is mounted pivotable with respect to the first flange. The sheave and second flange are fitted movable around the same rotation shaft.

The second flange is kept in the closed position by means of a push-button that is partially housed in the securing head and that is depressed into a through hole of the second flange to prevent rotation. In an alternative embodiment, the second flange forms a rectangular notch that collaborates with a rotatable hook of the securing head. The hook is also rectangular in shape and of similar dimension to that of the notch to prevent any rotation of the second flange when the hook is engaged in the notch. The document U.S. Pat. No. 7,168,687 proposes to allow opening of the pulley by means of a single disengagement motion of the safety means, typically by pressing the push-button into the body to release the second flange. It turns out that, in a number of technical fields, this opening operation can be considered to be dangerous as the push-button may come into contact with an external element which may actuate the button.

OBJECT OF THE INVENTION

One object of the invention consists in providing a pulley provided with a fixed closed position by means of a fastener wherein disengagement of the fastener is more complex while remaining easy to use, in particular with one hand and possibly with one finger. For this purpose, the pulley comprises:

- a securing head,
- a first flange fixed to the securing head,
- a first shaft extending from the first flange,
- a second flange mounted rotatable between an open position and a closed position around the first shaft with respect to the first flange, the second flange having an inner surface and an outer surface,
- a sheave mounted movable in rotation around the first shaft between the first flange and the second flange, the sheave being facing the inner surface of the second flange,
- a rod fixed to the first flange and mounted movable between a first position and a second position with a first movement, the rod being salient from the outer surface of the second flange.

In the first position, the rod engages with the second flange in the closed position to keep the second flange in the closed position. In the second position, the rod allows rotation of the second flange.

The pulley is remarkable in that a blanking plate is fixed on the second flange and is mounted movable between a first position and a second position with a second movement, the first position of the blanking plate being arranged so that a blanking area at least partially covers the rod in the first position so as to prevent movement of the rod from the first position to the second position.

In one development, the blanking plate is rotatable.

In advantageous manner, movement of the blanking area from the first position to the second position corresponds to movement of the blanking area towards the first shaft.

Preferentially, the rod is terminated by a gripping area having a broader cross-section compared with a cross-section of the rod engaging with the second flange, and the blanking plate has a blanking area completely covering the gripping area in a direction parallel to the axis of rotation of the second flange with respect to the first flange.

In a particular embodiment, the gripping area is covered by a coloured indicator and the blanking area completely masks the coloured indicator in a direction of observation parallel to the axis of rotation of the second flange with respect to the first flange when the rod is in the first position, the blanking plate is in the first position and the second flange is in the closed position.

Advantageously, movement of the rod from the first position to the second position corresponds to a movement of the rod away from the first shaft.

In a preferential configuration, the blanking plate is mounted rotatable around a second rotation shaft fixed to the second flange, the second rotation shaft being salient from the inner surface of the second flange. The securing head defines a groove operating in conjunction with the second rotation shaft to form an end-of-travel stop when rotation of the second flange takes place from the second position to the first position.

Preferentially, the groove has a lateral dimension that matches the lateral dimension of the second rotation shaft to perform a strain take-up between the securing head and the second flange.

In one development, the distance separating the first shaft and the second rotation shaft is greater than the distance separating the blanking area and the second rotation shaft.

In preferential manner, the second flange has a side wall defining a hook engaging with the rod.

In a particular embodiment, the rod and blanking plate are arranged so as to be devoid of movement in a direction parallel to the axis of rotation of the second flange with respect to the first flange.

In one development, the sheave is mounted movable in rotation in one direction of rotation only.

Advantageously, the pulley comprises a clamp movable with respect to the first flange and with respect to the first shaft, the clamp being associated with a flexible means configured to apply a stress on the clamp to direct it towards the sheave and enable rotation of the sheave in one direction only.

It is advantageous to provide for the pulley to comprise:

- an additional second flange mounted rotatable between an open position and a closed position around the first shaft with respect to the first flange, the additional second flange having an inner surface and an outer surface, a second sheave mounted movable in rotation around the first shaft between the first flange and the additional second flange, the sheave being facing the inner surface of the second flange, the second sheave being separated from the sheave by the first flange.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which:

FIG. 5 schematically represents a pulley with a movable flange that moves from the open position to the closed position with the movable flange that moves the blocking rod to the open position;

FIG. 6A schematically represents a front view and FIG. 6B represents a longitudinal cross-sectional view of FIG. 6A in the direction A-A of a pulley in the closed position with the blanking plate hiding the blocking rod;

FIG. 8 schematically represents another embodiment of a pulley comprising two sheaves.

DESCRIPTION OF THE EMBODIMENTS

Figure 1:
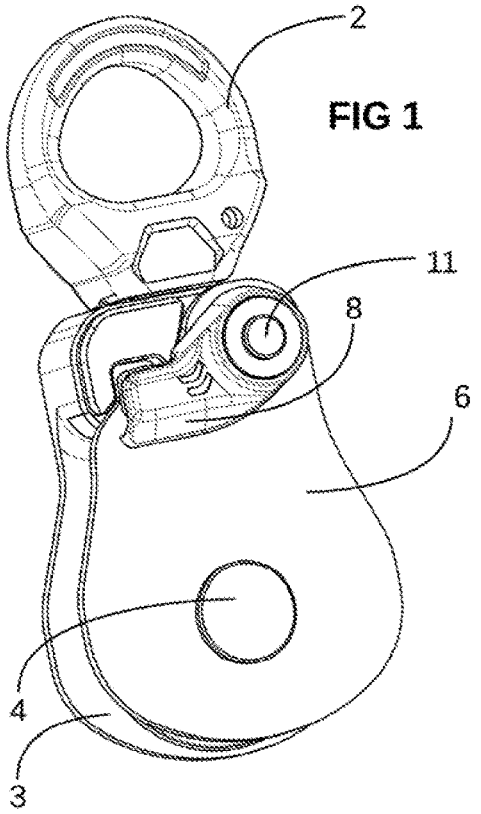
FIG. 1 schematically illustrates a pulley in the closed position with the blanking plate hiding the blocking rod.

As illustrated in FIGS. 1 to 8, a pulley device 1 comprises a securing head 2 fixed to a first flange 3. Pulley 1 also comprises a first rotation shaft 4 that extends away from first flange 3. A sheave 5 is mounted rotatable around first rotation shaft 4. Sheave 5 is mounted movable with respect to first flange 3 and with respect to securing head 2. Sheave 5 is designed to collaborate with a rope. First rotation shaft 4 defines the axis of rotation of sheave 5. Securing head 2 defines a ring designed to attach pulley 1 to an anchor point, for example by means of a strap, a quick link or a carabiner.

In one embodiment, sheave 5 is mounted rotatable in two directions of rotation. In another embodiment, sheave 5 is mounted rotatable in one direction of rotation only. Sheave 5 is configured so as not to be able to perform any rotation in the other direction of rotation. Depending on the embodiments, sheave 5 has a smooth groove, or a groove defining a plurality of ribs that form constrictions in the groove to facilitate mechanical connection between the groove and rope thereby enhancing clamping of the rope. The sheave can also have a groove provided with gripping spikes that sink into the rope. The spikes can be oriented in such a way as to allow sliding of the rope in one direction of rotation and to prevent sliding of the rope with respect to sheave 5 in the second direction of rotation. In one embodiment, the pulley is a self-locking pulley.

It is possible to provide for sheave 5 to collaborate with a clamp movable with respect to first flange 3 and with respect to first rotation shaft 4. The movable clamp is fitted movable with respect to the sheave so as to move towards or away from sheave 5 and to define a space enabling a rope to be inserted between sheave 5 and the clamp. Advantageously, the pulley comprises a spring or a flexible means that is connected on the one hand to the movable clamp and on the other hand to the first flange or to the securing head. The spring applies a bias force that directs the clamp towards the sheave to press the rope against the sheave and possibly to clamp the rope.

Preferentially, the movable clamp is configured to allow movement of the rope in a first direction and to prevent movement of the rope in the second direction. To prevent movement of the rope in the second direction, the movable clamp can be provided with gripping spikes. Movement of the rope in the second direction makes the clamp move towards the sheave which increases the strain on the rope and prevents movement of the latter once a threshold strain has been reached.

Pulley 1 further comprises a second flange 6 that is also mounted rotatable around first rotation shaft 4. Second flange 6 is mounted rotatable with respect to first flange 3 and to securing head 2. Second flange 6 has an inner surface and an outer surface. Sheave 5 is facing the inner surface of second flange 6. Sheave 5 is arranged between first flange 3 and second flange 6 in the direction of the axis of rotation. Second flange 6 defines a first position that collaborates with the securing head to close pulley 1. Second flange 6 also defines a second position that corresponds to an open position of pulley 1.

Pulley 1 also comprises a locking mechanism configured to lock second flange 6 in the first position with respect to first flange 3. In the closed position, the rope or cable fitted in pulley 1 cannot be extracted. It is also no longer possible to insert a rope or cable therein. In the open position, it is possible to install a cable or a rope between the two flanges 3 and 6, advantageously in contact with sheave 5.

The locking mechanism has a rod 7 fixed to first flange 3 or to securing head 2. Rod 7 is mounted movable between a first position and a second position by means of a first movement. The first movement can be a translational movement or a rotational movement or a combination of the two. The first movement is not a translation of the rod in a direction parallel to the axis of rotation of sheave 5.

In the first position, rod 7 engages with second flange 6 to secure second flange 6 in the first position. In the second position, rod 7 allows rotation of second flange 6. Rod 7 is salient from the outer surface of second flange 6.

Advantageously, in the second position, rod 7 is not in contact with second flange 6. Actuation of rod 7 with the first movement makes it possible to move from the first position of rod 7 to the second position of rod 7 in a first actuation direction and from the second position of rod 7 to the first position of rod 7 in a second actuation direction opposite from the first actuation direction.

Pulley 1 comprises a blanking plate 8 fixed to second flange 6 and mounted movable between a first position and a second position with a second movement different from the first movement. The first movement is different from the second movement which means that the user has to perform two different consecutive movements to actuate blanking plate 8 and then actuate actuating rod 7 in order to then achieve rotation of second flange 6. The use of two different consecutive movements on two different parts enables disengagement of rod 7 to be reduced and even prevented in comparison with a single disengagement movement of rod 7 as in the prior art.

Blanking plate 8 is configured to at least partially cover rod 7 so as to prevent actuation and therefore movement of rod 7 from the first position to the second position. By covering rod 7, blanking plate 8 prevents the user from coming into contact with rod 7 thereby preventing the user from effecting a movement of rod 7 from the first position to the second position. Blanking plate 8 is not configured to keep second flange 6 in the first position by means of a mechanical connection. Blanking plate 8 fitted on the outer surface of second flange 6 is not in direct contact with first flange 3 and does not act directly in keeping second flange 6 in the closed position. In advantageous manner, blanking plate 8 does not engage with first flange 3 or securing head 2. Blanking plate 8 advantageously forms a cavity that is designed to cover rod 7. In advantageous manner, blanking plate 8 never comes into contact with rod 7.

Preferentially, movement of blanking plate 8 from the first blanking plate position to the second blanking plate position takes place in a first direction of movement that is opposite from the second direction of movement of rod 7 when movement of rod 7 takes place from the first rod position to the second rod position. The first direction of movement of the blanking plate can be a movement towards first rotation shaft 4 whereas the second direction of movement can be a movement away from first rotation shaft 4. The opposite configuration is also possible.

The illustrated configuration enables a user's finger to come into contact with blanking plate 8. The finger moves in the first direction of movement so as to move blanking plate 8 and make rod 7 accessible. Once rod 7 has become accessible, the user's finger returns to its initial position moving in the second direction opposite from the first direction. The finger comes into contact with rod 7 and moves rod 7 from the first position to the second position to release second flange 6 and allow the latter to rotate. The finger can apply a third movement to move second flange 6. The finger can press on blanking plate 8 to cause rotation of second flange 6.

It is advantageous to use a rotary blanking plate 8 as implementation and movement of the latter with one finger are easier to perform. It is also advantageous to combine a rotary blanking plate with a rod in translation as this facilitates disengagement of the rod when the finger returns in the second direction of movement.

In an exclusively rotary configuration, the vector connecting rod 7 with its axis of rotation and the vector connecting blanking plate 8 with its axis of rotation are both directed in the same direction, i.e. towards the same side wall of the pulley. This configuration is more advantageous than the one where rod 7 and blanking plate 8 are arranged between the two axes of rotation or substantially between the two axes of rotation.

In advantageous manner, second flange 6 defines a first end-of-travel stop that is configured to prevent movement of blanking plate 8 that moves in the first direction. Once blanking plate 8 reaches the first end-of-travel stop, application of a force in the first direction results in rotation of the second flange with respect to first flange 3 when rod 7 is in the second position. If rod 7 is in the first position, the force applied on blanking plate 8 is impeded by the mechanical connection that exists between rod 7 and second flange 6. The distance between blanking plate 8 and its rotation shaft is smaller than the distance between the first and second rotation shafts.

In advantageous manner, second flange 6 defines a second end-of-travel stop that defines the first position and/or that is configured to prevent blanking plate 8, in its first position, from coming into direct contact with rod 7. The second end-of-travel stop is configured to prevent movement of blanking plate 8 beyond its first position in the second direction of movement. By preventing movement of blanking plate 8, an involuntary movement of blanking plate 8 in the second direction of movement is impossible thus preventing movement of rod 7 by means of blanking plate 8.

First rotation shaft 4 is fixed to first flange 3 and advantageously mounted in fixed manner on first flange 3. Sheave 5 and second flange 6 are both mounted rotatable with respect to first flange 3 around the same axis of rotation. This configuration makes it possible to have a pulley that is compact and easy to open.

In advantageous manner, rotation shaft 4 defines the axis of rotation of sheave 5 and of second flange 6 and this axis of rotation is perpendicular to the outer surface of first flange 3.

In preferential manner, blanking plate 8 is mounted rotatable thereby facilitating movement of blanking plate 8 with one hand and advantageously with one finger. This configuration is particularly advantageous when blanking plate 8 is associated with the first end-of-travel stop as it enables rotation of second flange 6 to be obtained. Such a configuration is preferential when the axis of rotation of blanking plate 8 is distant from the first axis of rotation by a larger distance than the radius of sheave 5.

In an advantageous configuration, a spring 9 is connected to second flange 6 and to connector 8. Spring 9 is configured to bias connector 8 to its first position. Spring 9 provides an enhanced safety as blanking plate 8 returns naturally to its first position to cover rod 7. In advantageous manner, blanking plate 8 is separated from second flange 6 by the end of rod 7. Preferentially, spring 9 is separated from first flange 3 by second flange 6.

In a particular embodiment, second flange 6 comprises a pin 6*a* mounted salient and operating in conjunction with a hollow area of blanking plate 8. The hollow area has two side walls that come into contact with pin 6*a* to form the two end-of-travel stops of blanking plate 8 in both directions of movement. The distance between the two side walls defines the angular difference of blanking plate 8 between the two extreme positions of blanking plate 8.

In advantageous manner, a second spring 10 is connected on the one hand to securing head 2 or to first flange 3 and on the other hand to rod 7. Second spring 10 is configured so that rod 7 is biased to the first position if no force is applied thereon.

In an illustrated particular configuration, blanking plate 8 has a blanking area covering rod 7 in the first rod position. Movement of blanking plate 8 from the first position to the second position corresponds to movement of the blanking area towards first rotation shaft 4. In its first position, the blanking area is facing rod 7 along the axis of rotation of first rotation shaft 4. Preferentially, when rod 7 is in the second position (allowing rotation of second flange 6), rod 7 is visible regardless of the position of blanking plate 8, thereby enabling the user to observe that second flange 6 will not be kept in the closed position thereby improving the operational safety of the pulley.

When rod 7 and blanking plate 8 are both in the first position and second flange 6 is closed, blanking plate 8 covers rod 7 in the direction of the axis of rotation of sheave 5 thereby preventing undesired actuation thereof.

Preferentially, rod 7 is terminated by a gripping area having an enlarged cross-section with respect to a cross-section of rod 7 engaging with second flange 6. Blanking plate 8 has a blanking area totally covering the gripping area in a direction parallel to the axis of rotation of second flange 6 with respect to first flange 3.

In advantageous manner, the gripping area is covered by a coloured indicator having a different colour from the colour of blanking plate 8 and the colour of first flange 3. The blanking area totally masks the coloured indicator when rod 7 and blanking plate 8 are in the first position and the pulley is closed. The masking can be observed in a direction of observation parallel to the axis of rotation of second flange 6 with respect to first flange 3. The use of a coloured indicator makes it possible to detect quickly that blanking plate 8 is not located, with respect to actuating rod 7, in a position representative of securing of pulley 1 in the closed position.

In an advantageous configuration, second flange 6 defines a sliding ramp for rod 7. When movement of second flange 6 takes place from the open position to the closed position, rod 7 comes into contact with the sliding ramp thereby making rod 7 move out of its locking position. In this way when second flange 6 returns to its closed position, the user is able to detect quickly and visually that second flange 6 has not yet reached the closed position thereby enhancing safety. Once the closed position has been reached, rod 7 leaves the ramp to collaborate with a hook defined in the side wall of the second flange.

In a preferential configuration, movement of rod 7 from the first position to the second position corresponds to a movement of rod 7 away from rotation shaft 4. Rod 7 moves at least with a component perpendicular to the axis of rotation between the two flanges 3 and 6. Advantageously, rod 7 moves only in a plane perpendicular to the axis of rotation of flange 6, for example in rotation or in translation.

Advantageously, blanking plate 8 is mounted rotatable around a second rotation shaft 11 fixed to second flange 6. Second rotation shaft 11 moves when rotation of second flange 6 takes place.

In a particular embodiment, second rotation shaft 11 is salient from the inner surface of second flange 6. In preferential manner, securing head 2 defines a groove 12 collaborating with second rotation shaft 11 to form an end-of-travel stop when rotation of second flange 6 takes place from the second position to the first position. When closing of pulley 1 takes place, second flange 6 pivots and second rotation shaft 11 comes into contact with groove 12 and slides along groove 12 until it reaches the end-of-travel stop defining the first position of second flange 6.

Second rotation shaft 11 is mounted on second flange 6 thereby making actuation of blanking plate 8 easier to perform. Actuation of blanking plate 8 can be performed independently from the position of second flange 6 with respect to first flange 3. Blanking plate 8 is mounted rotatable with respect to second flange 6 around second rotation shaft 11 and second rotation shaft 11 is mounted movable in rotation with respect to first flange 3.

In an advantageous configuration, groove 12 has a lateral dimension that matches the lateral dimension of second rotation shaft 11 to perform a strain take-up between securing head 2 and second flange 6. In this configuration, the force applied by the rope on sheave 5 can result in bending of first rotation shaft 4. In order to be able to withstand higher stresses, it is advantageous to provide for second flange 6 to be mechanically connected to first flange 3 by means of a second mechanical connection different from first rotation shaft 4. The second mechanical connection is provided by second rotation shaft 11 that engages in securing head 2 or in first flange 3. The force applied on sheave 5 is distributed over the two flanges 3 and 6.

In a particular configuration, application of a force on sheave 5 beyond a threshold value prevents opening of pulley 1. Such a force prevents rotation of second flange 6 which remains jammed in groove 12. A strong force applied on sheave 5 increases the friction force of shaft 11 with groove 12 thereby preventing opening of pulley 1.

In the particular configuration illustrated, second flange 6 has a side wall defining a hook or a recess engaging with rod 7. Once rod 7 is blocked in the hook or recess, second flange 6 remains in the closed position preventing rotation thereof. The side wall connects the inner surface with the outer surface.

In one embodiment, rod 7 and blanking plate 8 are arranged so as not to have any movement in a direction parallel to the axis of rotation of second flange 6 with respect to first flange 3. Rod 7 and blanking plate 8 are not configured to allow depression of rod 7 into securing head 2 thereby preventing unlocking of second flange 6 in involuntary manner.

In a particular embodiment, first flange 3 is formed in monolithic manner with a part of securing head 2. In advantageous manner, securing head 2 is mounted rotatable around an axis of rotation that is perpendicular to the axis of rotation of sheave 5.

Figure 7:
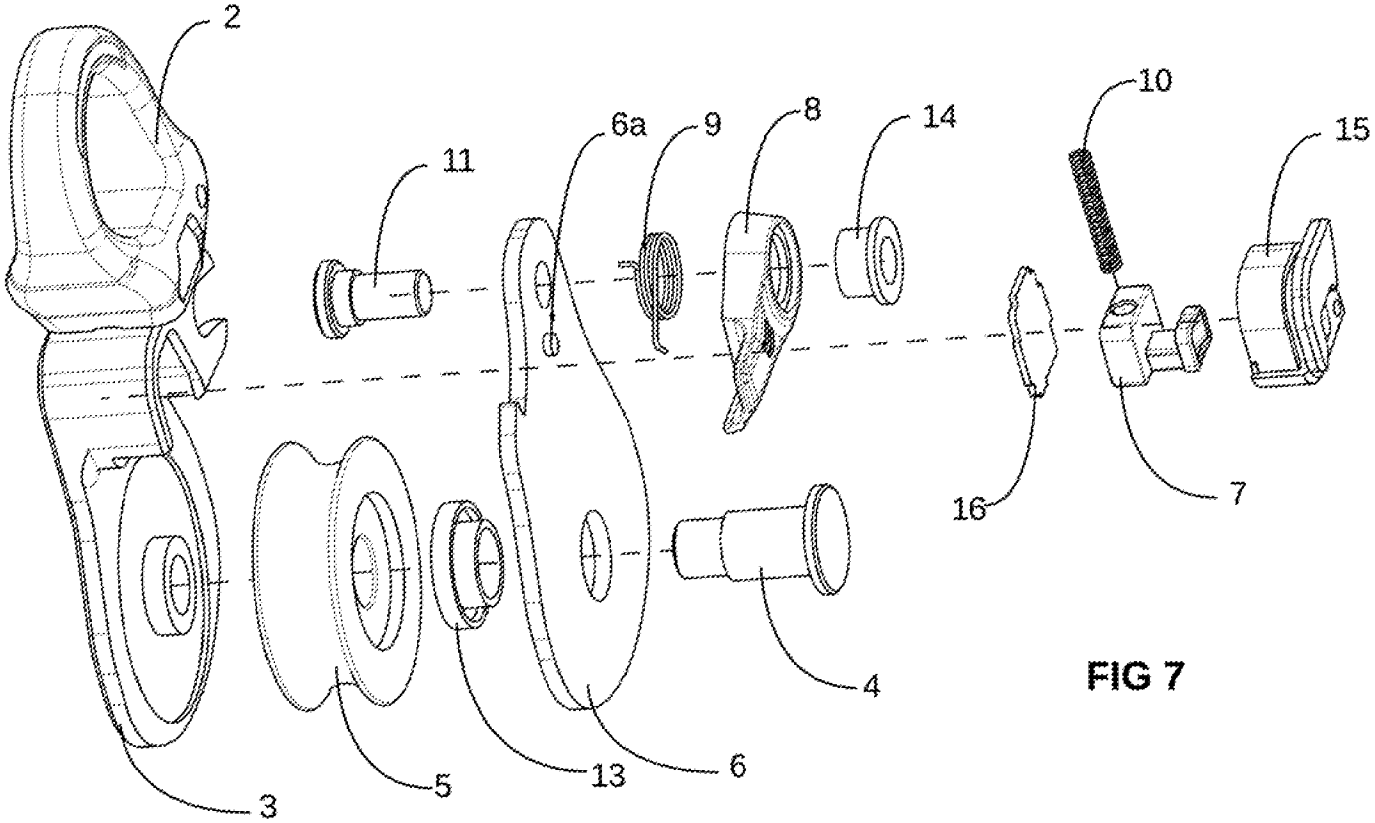
FIG. 7 schematically represents an exploded view of a pulley.

In the embodiment illustrated in FIG. 7, sheave 5 is mounted on a bearing 5*a*, for example a ball bearing, that is connected between first rotation shaft 4 and sheave 5. An adapter 13 can be fitted on first rotation shaft 4 to define the rotation of sheave 5 more precisely. In advantageous manner, blanking plate 8 is fixed to rotation shaft 11 by means of a nut 14. It is also advantageous to provide for securing head 2 to define a housing for insertion of rod 7 and of spring 10. Rod 7 and spring 10 are preferentially installed in a case 15 that can be closed by a cover 16.

In advantageous manner, when it rotates, blanking plate 8 never overshoots the line connecting the two rotation shafts illustrated for example by line A-A of FIGS. 6A and 6B.

FIG. 1 illustrates a pulley 1 in the closed position with rod 7 and blanking plate 8 both in the first position. The two flanges 3 and 6 are mechanically connected by means of first rotation shaft 4 and rod 7. Blanking plate 8 completely covers rod 7 to prevent any involuntary actuation thereof. Second flange 6 is kept in the closed position by means of rod 7.

Figure 2:
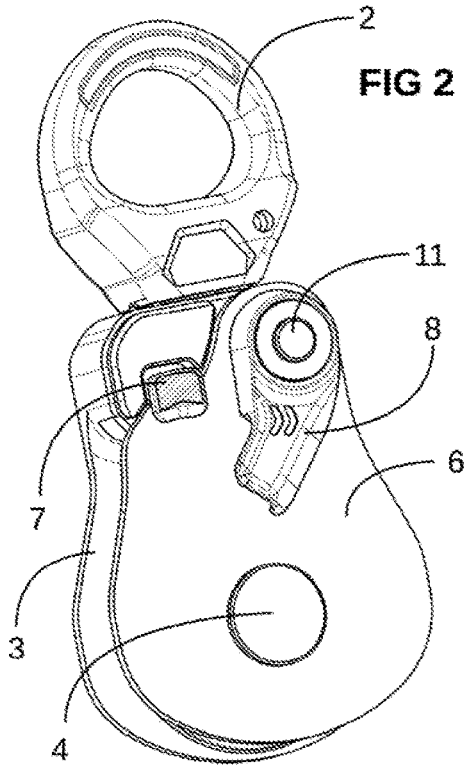
FIG. 2 schematically represents a pulley in the closed position with the blanking plate leaving the blocking rod accessible.

FIG. 2 illustrates movement of blanking plate 8 from the first position to the second position resulting in rod 7 being uncovered. Blanking plate 8 is in the second position and rod 7 is in the first position. Second flange 6 is kept in the closed position by means of rod 7. Blanking plate 8 no longer protects rod 7 which can be actuated to allow rotation of second flange 6 with respect to first flange 3. Movement of blanking plate 8 is achieved by pressing for example with one finger and effecting a first movement. This first movement can move the finger and therefore blanking plate 8 towards first rotation shaft 4.

Figure 3:
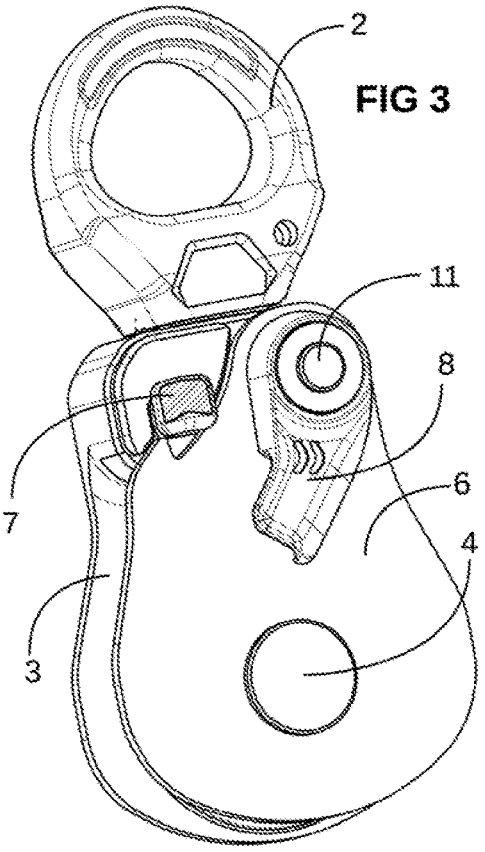
FIG. 3 schematically represents a pulley in the closed position with the blanking plate leaving the blocking rod accessible and the blocking rod in a position allowing rotation of the movable flange.

FIG. 3 illustrates movement of rod 7 from the first position to the second position. Rod 7 is in the second position allowing rotation of second flange 6. The user's finger has moved with the first movement to move blanking plate 8 aside. The user's finger then moves with a second movement opposite from the first movement. The finger returns to its initial position for example by sliding on second flange 6. The finger comes into contact with rod 7 and continues its movement which moves rod 7 from the first position to the second position. Second flange 6 can then be moved.

Figure 4:
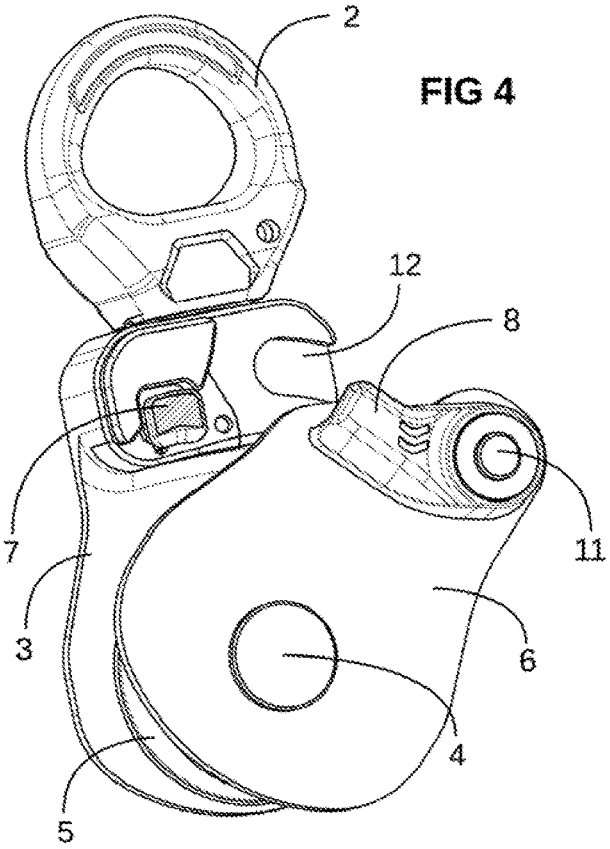
FIG. 4 schematically represents a pulley in the open position with the movable flange out of alignment with the fixed flange.

FIG. 4 illustrates rotation of second flange 6 with respect to first flange 3. Rotation of second flange 6 can be obtained by moving the finger from rod 7 and directing it towards second rotation shaft 11. Three consecutive movements of the finger can be applied to disengage blanking plate 8, disengage rod 7 and then move second flange 6.

FIG. 5 illustrates rotation of second flange 6 with respect to first flange 3 from the open position to the closed position. As no force is applied on blanking plate 8, spring 9 moves blanking plate 8 back to the first position. Blanking plate 8, in its first position, does not oppose return of second flange 6 to the closed position. When it returns to the first position, second flange 6 pushes rod 7 to the second position. Second flange 6 compels rod 7 to leave the first position and this movement is visible with respect to blanking plate 8 which means that the user can know at a glance that second flange 6 is not yet in the closed position.

FIGS. 6A and 6B illustrate the pulley that has returned to the closed position with the blanking plate and rod both in the first position. Cutting plane A-A illustrated in FIG. 6A and FIG. 6B passes through the first rotation shaft 4 and second rotation shaft 11. Second rotation shaft 11 presents a complementary shape to groove 12 arranged in securing head 2 to facilitate strain take-up.

FIG. 7 represents an exploded view of pulley 1.

FIG. 8 represents an embodiment in which the pulley has two sheaves or rollers mounted rotatable around a single rotation shaft 4. Sheave 5 and second sheave 5 are separated by first flange 3. Second sheave 5 is mounted movable in rotation with respect to first flange 3 and with respect to securing head 2. Second sheave 5 is designed to operate in conjunction with a rope. First rotation shaft 4 defines the axis of rotation of the two sheaves 5.

The pulley comprises an additional second flange 6 that is separated from first flange 3 by second sheave 5, and additional second flange 6 is mounted movable in rotation around first rotation shaft 4. Additional second flange 6 is mounted rotatable with respect to first flange 3 and to securing head 2. Additional second flange 6 has an inner surface and an outer surface. Second sheave 5 is facing the inner surface of additional second flange 6.

Additional second flange 6 defines a closed position and an open position. Additional second flange 6 defines a first position that collaborates with the securing head to close pulley 1. Additional second flange 6 also defines a second position that corresponds to an open position of pulley 1. Additional second flange 6 is openable independently from second flange 6.

Pulley 1 also comprises a second locking mechanism configured to block additional second flange 6 in the first position with respect to first flange 3. In the closed position, the rope or cable inserted in pulley 1 cannot be extracted. Nor is it possible to insert a rope or cable therein. In the open position, it is possible to fit a cable or a rope between first flange 3 and additional second flange 6. The ropes installed in the pulley are separated by first flange 3.

The additional locking mechanism has an additional rod 7 fixed to first flange 3 or to securing head 2. Additional rod 7 is mounted movable between a first position and a second position with a first movement. The first movement can be a translational movement or a rotational movement or a combination of the two. The first movement is not a translation of the additional rod along the axis of rotation of shaft 4.

In the first position, additional rod 7 engages with additional second flange 6 to keep additional second flange 6 in the first position. In the second position, additional rod 7 allows rotation of additional second flange 6. Additional rod 7 is salient from the outer surface of additional second flange 6. Advantageously, in the second position, additional rod 7 is not in contact with additional second flange 6. Actuation of additional rod 7 with the first movement makes it possible to move from the first position of additional rod 7 to the second position of additional rod 7 in a first actuating direction and from the second position of additional rod 7 to the first position of additional rod 7 with a second actuating direction opposite from the first actuating direction. The first movement can be a rotation or a translation. Installation of the additional rod can be performed according to one of the multiple configurations of the rod described in the foregoing.

An additional blanking plate 8 is mounted on additional second flange 6 according to one of the configurations already presented for installation of the blanking plate on second flange 6. Opening of second flange 6 is performed independently from opening of additional second flange 6.

The invention claimed is:

1. Pulley comprising:

a securing head, a first flange fixed to the securing head, a first rotation shaft extending from the first flange, a second flange mounted rotatable between an open position and a closed position around the first rotation shaft with respect to the first flange, the second flange having an inner surface and an outer surface, a sheave mounted movable in rotation around the first rotation shaft between the first flange and the second flange, the sheave being facing the inner surface of the second flange, a rod fixed to the first flange and mounted movable between a first rod position and a second rod position with a first movement, the rod being salient from the outer surface of the second flange, a blanking plate fixed on the second flange and mounted movable between a first blanking plate position and a second blanking plate position with a second movement, the first blanking plate position being arranged so that a blanking area at least partially covers the rod in the first rod position so as to prevent movement of the rod from the first rod position to the second rod position, covering being observed in a direction of observation parallel to an axis of rotation of the second flange with respect to the first flange, wherein, in the first rod position, the rod engages with the second flange in the closed position to keep the second flange in the closed position and wherein, in the second rod position, the rod allows rotation of the second flange, and wherein movement of the rod from the first rod position to the second rod position is different from a translation of the rod in a direction parallel to the axis of rotation of the second flange with respect to the first flange.

2. Pulley according to claim 1, wherein the blanking plate is mounted rotatable.

3. Pulley according to claim 1, wherein movement of the rod from the first position to the second position corresponds to a movement of the rod away from the first rotation shaft.

4. Pulley according to claim 1, wherein the second flange has a side wall defining a hook engaging with the rod.

5. Pulley according to claim 1, wherein the rod and blanking plate are arranged so as to be devoid of movement in a direction parallel to the axis of rotation of the second flange with respect to the first flange.

6. Pulley according to claim 1, wherein the sheave is mounted movable in rotation in one direction of rotation only.

7. Pulley according to claim 1, comprising:

an additional second flange mounted rotatable between an open position and a closed position around the first rotation shaft with respect to the first flange, the additional second flange having an inner surface and an outer surface, a second sheave mounted movable in rotation around the first rotation shaft between the first flange and the additional second flange, the sheave being facing the inner surface of the second flange, the second sheave being separated from the sheave by the first flange.

8. Pulley according to claim 1 wherein the blanking plate is devoid of direct contact with first flange and with securing head.

9. Pulley comprising:

a securing head, a first flange fixed to the securing head, a first rotation shaft extending from the first flange, a second flange mounted rotatable between an open position and a closed position around the first rotation shaft with respect to the first flange, the second flange having an inner surface and an outer surface, a sheave mounted movable in rotation around the first rotation shaft between the first flange and the second flange, the sheave being facing the inner surface of the second flange, a rod fixed to the first flange and mounted movable between a first rod position and a second rod position with a first movement, the rod being salient from the outer surface of the second flange, a blanking plate fixed on the second flange and mounted rotatable between a first blanking plate position and a second blanking plate position with a second movement, the first blanking plate position being arranged so that a blanking area at least partially covers the rod in the first rod position so as to prevent movement of the rod from the first rod position to the second rod position, covering being observed in a direction of observation parallel to an axis of rotation of the second flange with respect to the first flange, wherein, in the first rod position, the rod engages with the second flange in the closed position to keep the second flange in the closed position, wherein, in the second rod position, the rod allows rotation of the second flange, and wherein movement of the blanking area from the first blanking plate position to the second blanking plate position corresponds to a movement of the blanking area towards the first rotation shaft.

10. Pulley comprising:

a securing head, a first flange fixed to the securing head, a first rotation shaft extending from the first flange, a second flange mounted rotatable between an open position and a closed position around the first rotation shaft with respect to the first flange, the second flange having an inner surface and an outer surface, a sheave mounted movable in rotation around the first rotation shaft between the first flange and the second flange, the sheave being facing the inner surface of the second flange, a rod fixed to the first flange and mounted movable between a first rod position and a second rod position with a first movement, the rod being salient from the outer surface of the second flange, the rod being terminated by a gripping area having a broader cross-section compared with a cross-section of the rod engaging with the second flange, a blanking plate fixed on the second flange and mounted movable between a first blanking plate position and a second blanking plate position with a second movement, the first blanking plate position being arranged so that a blanking area at least partially covers the rod in the first rod position so as to prevent movement of the rod from the first rod position to the second rod position, covering being observed in a direction of observation parallel to an axis of rotation of the second flange with respect to the first flange, wherein, in the first rod position, the rod engages with the second flange in the closed position to keep the second flange in the closed position and wherein, in the second rod position, the rod allows rotation of the second flange and wherein the blanking plate has a blanking area completely covering the gripping area in a direction parallel to the axis of rotation of the second flange with respect to the first flange, and wherein the gripping area is covered by a coloured indicator and wherein the blanking area completely masks the coloured indicator in a direction of observation parallel to the axis of rotation of the second flange with respect to the first flange when the rod is in the first rod position, the blanking plate is in the first blanking plate position and the second flange is in the closed position.

11. Pulley comprising:

a securing head, a first flange fixed to the securing head, a first rotation shaft extending from the first flange, a second flange mounted rotatable between an open position and a closed position around the first rotation shaft with respect to the first flange, the second flange having an inner surface and an outer surface, a sheave mounted movable in rotation around the first rotation shaft between the first flange and the second flange, the sheave being facing the inner surface of the second flange, a rod fixed to the first flange and mounted movable between a first rod position and a second rod position with a first movement, the rod being salient from the outer surface of the second flange, a blanking plate fixed on the second flange and mounted movable between a first blanking plate position and a second blanking plate position with a second movement, the first blanking plate position being arranged so that a blanking area at least partially covers the rod in the first rod position so as to prevent movement of the rod from the first rod position to the second rod position, covering being observed in a direction of observation parallel to an axis of rotation of the second flange with respect to the first flange wherein, in the first rod position, the rod engages with the second flange in the closed position to keep the second flange in the closed position and wherein, in the second rod position, the rod allows rotation of the second flange, and wherein the blanking plate is mounted rotatable around a second rotation shaft fixed to the second flange, the second rotation shaft being salient from the inner surface of the second flange, and wherein the securing head defines a groove operating in conjunction with the second rotation shaft to form an end-of-travel stop when rotation of the second flange takes place from the open position to the closed position.

12. Pulley according to claim 11, wherein the groove has a lateral dimension that matches the lateral dimension of the second rotation shaft to perform a strain take-up between the securing head and the second flange.

13. Pulley according to claim 12, wherein a distance separating the first rotation shaft and the second rotation shaft is greater than a distance separating the blanking area and the second rotation shaft.

* * * * *